US006485801B1

(12) United States Patent
Chen

(10) Patent No.: US 6,485,801 B1
(45) Date of Patent: Nov. 26, 2002

(54) 3D HANGING ORNAMENT

(76) Inventor: Teng-Kuei Chen, 11 Fl., No. 63, Lane 122, Sec. 4, Jen-Ai Rd., Taipei (TW)

( * ) Notice: Subject to any disclaimer, the term of this patent is extended or adjusted under 35 U.S.C. 154(b) by 59 days.

(21) Appl. No.: 09/677,724

(22) Filed: Oct. 2, 2000

(30) Foreign Application Priority Data

Dec. 28, 1999 (TW) ..... 88222233

(51) Int. Cl.[7] ..... A47G 47/00

(52) U.S. Cl. ..... 428/28; 428/7; 428/15; 428/105; 428/115; 428/542.2; D21/465; D21/467; 40/617; 446/227

(58) Field of Search ..... 428/7, 15, 28, 428/542.2, 105, 115; 40/617; D21/465, 467; 446/227, 228

(56) References Cited

U.S. PATENT DOCUMENTS 4,531,319 A * 7/1985 Saxton ..... 40/539
4,648,548 A * 3/1987 Shin ..... 229/8
6,261,658 B1 * 7/2001 Schmidt ..... 428/40.1
6,265,035 B1 * 7/2001 Snidreman ..... 428/11

* cited by examiner

*Primary Examiner*—Deborah Jones
*Assistant Examiner*—Abraham Bahta
(74) *Attorney, Agent, or Firm*—Jackson Walker L.L.P.

(57) ABSTRACT

A three-dimensional hanging ornament transformed from a flexible sheet printed with various patterns, which includes a body portion and at least one ornamental portion. At least one multiple connecting strip is connected with the body portion at a lower end thereof and connected with the ornamental portion at an upper end thereof. A perforated line is defined around outer edges of the body portion, the ornamental portion and the connecting strip, whereby the ornamental portion and the connecting strip, or the ornamental portion, the connecting strip and the body portion can be separated either partly or wholly from the sheet. When the hanging ornament is hung in various statuses, the ornamental portion is suspended and streamed in the air, in such a way the sheet with patterns is transformed into a three-dimensional hanging ornament.

7 Claims, 5 Drawing Sheets

3D HANGING ORNAMENT

BACKGROUND OF THE INVENTION

1. Field of the Invention

The present invention relates to a hanging ornament with dynamic three-dimensional contouring transformed from a flexible sheet printed with various patterns.

2. Description of Related Art

Homes are commonly decorated with various ornaments, such as plants, paintings, novelties, and hanging ornaments, etc. However, conventional ornaments including normal hanging ornaments are mostly in static states, and this static aspect means that people quickly lose interest in them.

Therefore, it is an objective of the invention to provide a hanging ornament with dynamic interest to mitigate and/or obviate the aforementioned problems.

SUMMARY OF THE INVENTION

The object of the present invention is to provide a hanging ornament, which is transformed from a flexible sheet printed with various patterns including a body portion and multiple ornamental portions. Multiple connecting strips are respectively connected with the body portion at lower ends thereof and connected with the relative ornamental portions at upper ends thereof. A perforated line is defined around outer edges of each of the body portion, the ornamental portions and the connecting strips, whereby the ornamental portions and the connecting strips, or the ornamental portions, the connecting strips and the body portion can be partly separated from the sheet. When the hanging ornament is hung in various statuses, the ornamental portions are respectively suspended and streamed in the air, in such a way that the sheet with the patterns is transformed into a three-dimensional hanging ornament, which is really dynamic, interesting and has plenty of variety.

Other objects, advantages and novel features of the invention will become more apparent from the following detailed description when taken in conjunction with the accompanying drawings.

DETAILED DESCRIPTION OF THE PREFERRED EMBODIMENT

Figure 1:
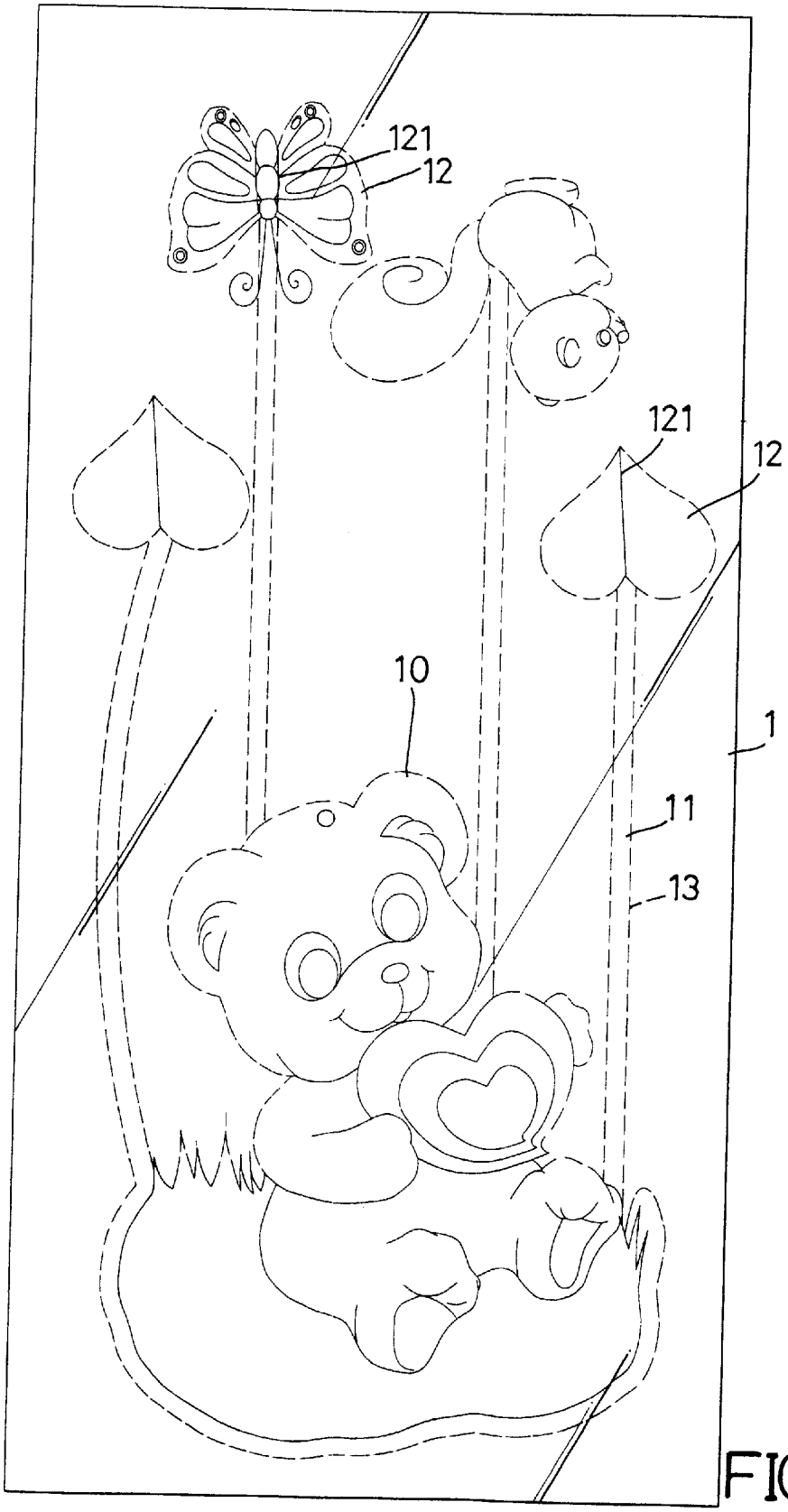
FIG. 1 is a plan view of a hanging ornament in accordance with the present invention.

With reference to FIG. 1, a hanging ornament is made from a flexible sheet (1) printed with various patterns, which includes a body portion (10) and at least one ornamental portion (12). In the preferred embodiment, multiple ornamental portions (12) are provided and referred to as such hereinafter. Multiple connecting strips (11) are respectively connected with the body portion (11) at lower ends thereof and connected with the relative ornamental portions (12) at upper ends thereof.

The body portion (10) and the multiple ornamental portions (12) are respectively printed with various types of patterns, such as luminous patterns, gold stamping patterns, laser hologram patterns, etc.

A perforated line (13) is defined around outer edge of each of the body portion (10), the connecting strips (11) and the ornamental portions (12), whereby the ornamental portions (12), the connecting strips (11) and the body portion (10) can be partly separated from the sheet (1) along the perforated lines (13).

Figure 2:
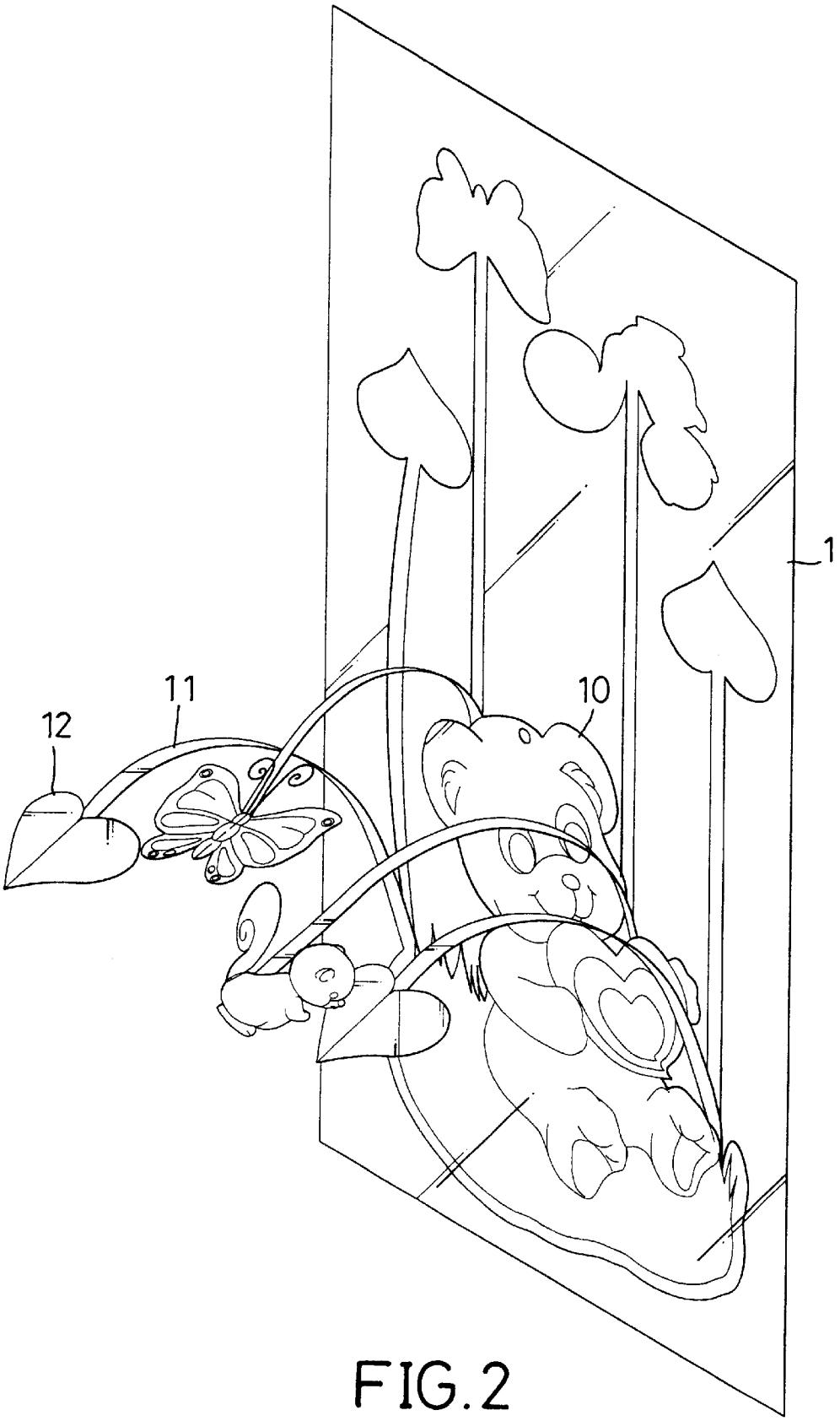
FIG. 2 is a perspective view of a first embodiment of the hanging ornament in accordance with the present invention.

In a first embodiment as shown in FIG. 2, the sheet (1) is pasted on a flat surface. The ornamental portions (12) and the connecting strips (11) are partly separated from the sheet (1). By the sole weight of each ornamental portion (12) and elasticity of the respective connecting strip (11), the ornamental portions (12) are suspended in the air and can move up and down in response to air currents.

The ornamental portions (12) can also be folded along folding lines (121) defined thereon to change their contouring from two dimensions to three dimensions.

Figure 3:
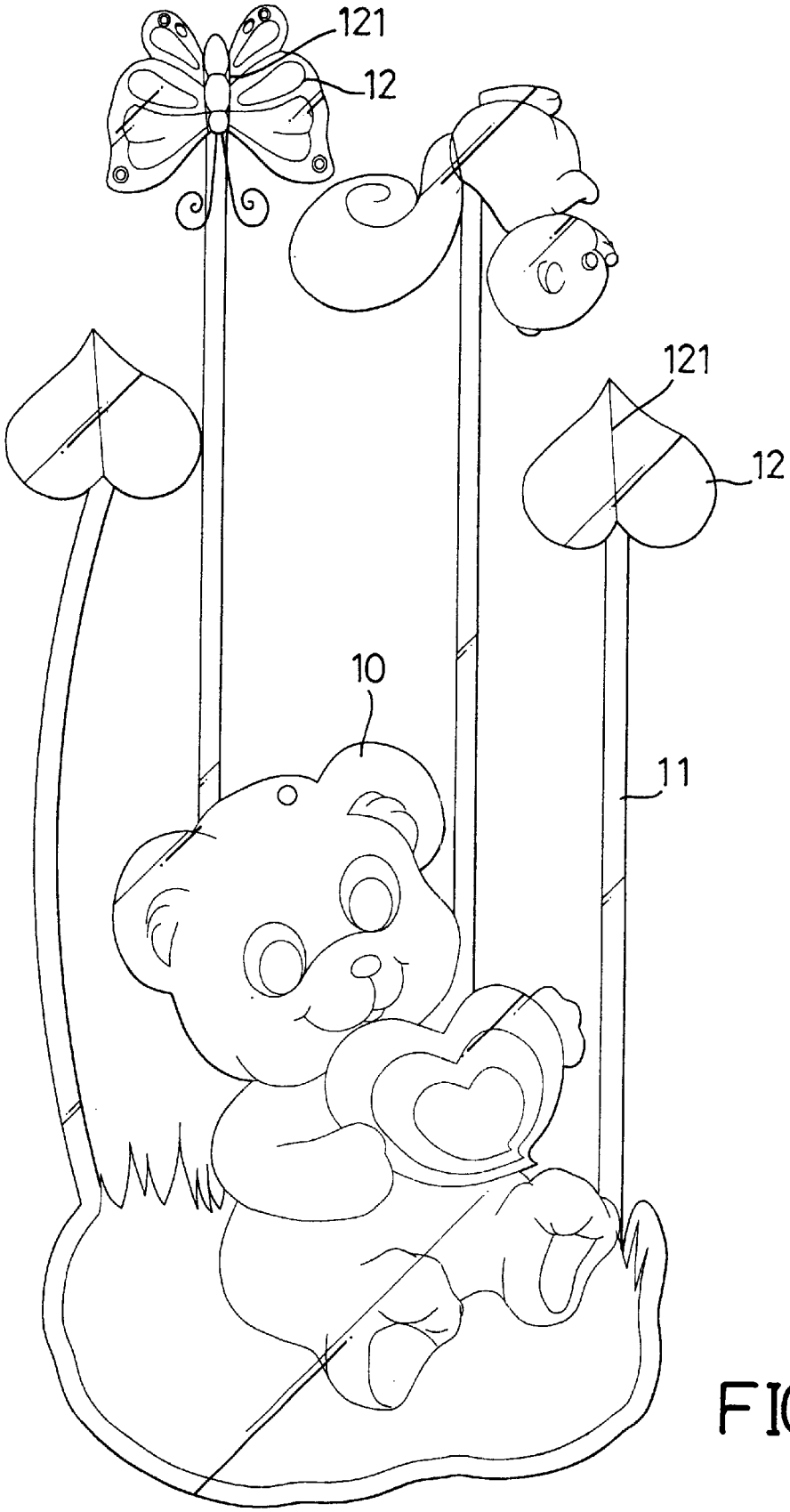
FIG. 3 is a plan view of a second embodiment of the hanging ornament in accordance with the present invention.
Figure 4:
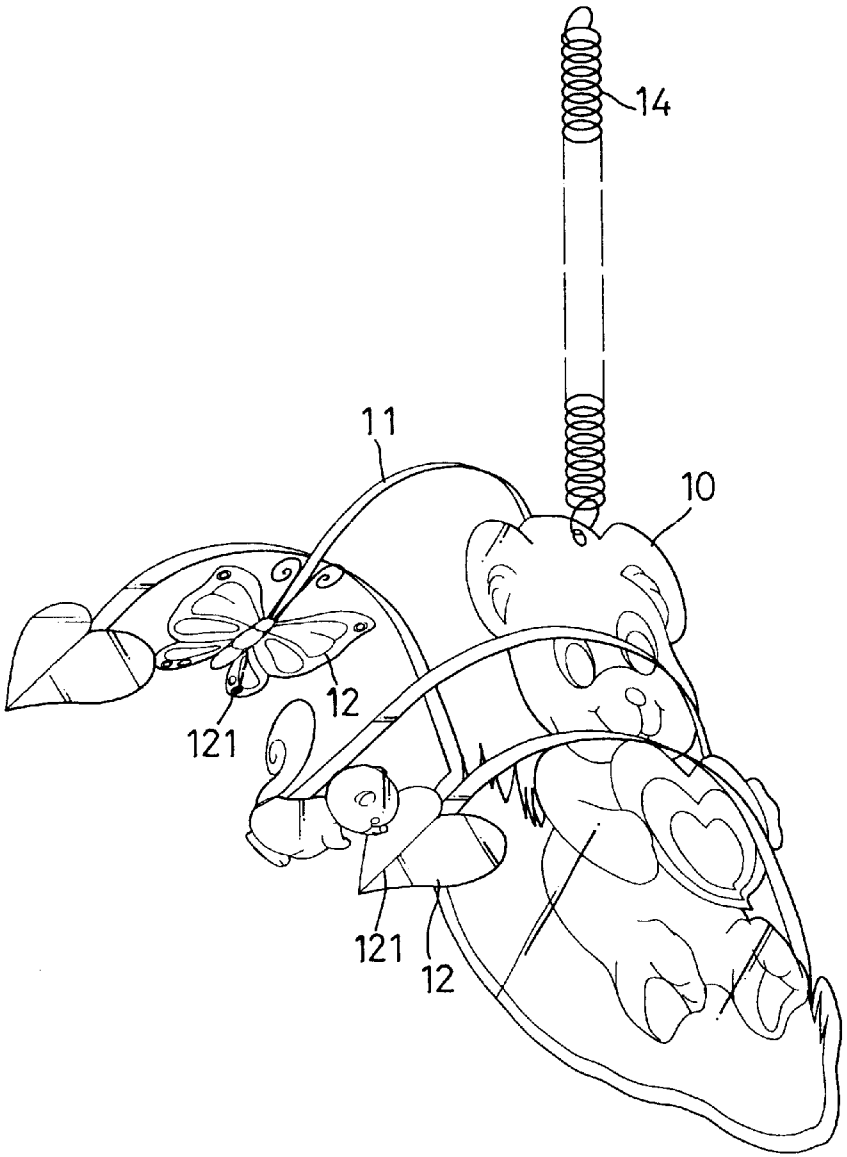
FIG. 4 is a perspective schematic view of the second embodiment of the hanging ornament in accordance with the invention in a first using status.
Figure 5:
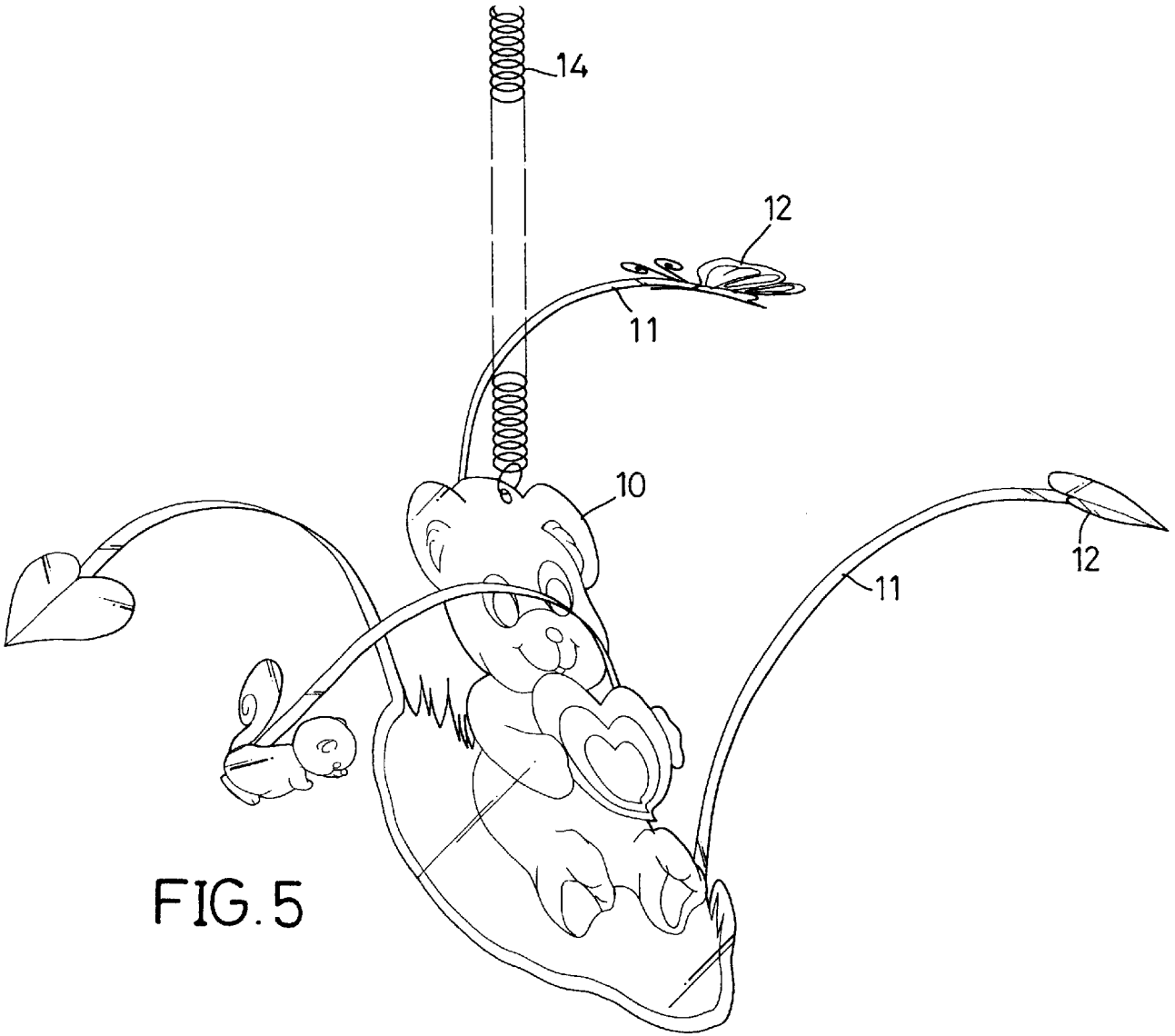
FIG. 5 is a perspective schematic view of the second embodiment of the hanging ornament in accordance with the invention in a second using status.

In a second embodiment as shown in FIG. 3, the body portion (10), the connection strips (11) and the ornamental portions (12) are separated from the sheet (1) completely. Then the body portion (10) of the hanging ornament can be suspended via a hanging element (14), such as a spring, an elastic element, a suction cup, or a paste element etc. FIGS. 4 and 5 are two different examples of handing status of the hanging ornament. The ornamental portions (12) are respectively suspended and streamed in the air by their sole weight and the elasticity of the connecting strips (11).

The hanging ornament of the invention has following advantages:

1. the hanging ornament with three-dimensional contouring is transformed from a flexible sheet printed with a patterns, so that the fabrication cost of the hanging ornament is low; and
2. the ornamental effect of the hanging ornament is dynamic, interesting and has plenty of variety.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A hanging ornament transformed from a flexible sheet (1) printed with various patterns, which includes a body portion (10) and at least one ornamental portion (12), wherein at least one connecting strip (11) is connected with the body portion (10) at a lower end thereof and connected with the at least one multiple ornamental portion (12) at an upper end thereof;

the body portion (10) and the ornamental portion (12) are respectively printed with various patterns; and a perforated line (13) is defined around respective outer edges of the connecting strip (11) and the ornamental portion (12), whereby the ornamental portion (12) and the connecting strip (11) can be partly separated from the sheet (1), and the ornamental portion (12) is suspended by elasticity of the connecting strip (11).

2. The hanging ornament as claimed in claim 1, wherein the perforated line (13) is defined around respective outer edges of the body portion (10), the connecting strip (11) and the ornamental portion (12), whereby the body portion (10), the connecting strip (11) and the ornamental portion (12) can be separated from the sheet (1) completely.

3. The hanging ornament as claimed in claim 1, wherein the ornamental portion (12) and the body portion (10) can be folded along folding lines (121) defined thereon.

4. The hanging ornament as claimed in claim 1, wherein the body portion (10) and the ornamental portion (12) are respectively printed with luminous patterns.

5. The hanging ornament as claimed in claim 1, wherein the body portion (10) and the ornamental portion (12) are respectively printed with gold stamping patterns.

6. The hanging ornament as claimed in claim 1, wherein the body portion (10) and the ornamental portion (12) are respectively printed with laser hologram patterns.

7. The hanging ornament as claimed in claim 1, wherein there are plurality of ornamental portions (12) and plurality of connecting strips (11) corresponding to the plurality of ornamental portions (12).

* * * * *